US005812969A

United States Patent [19]

Barber, Jr. et al.

[11] Patent Number: 5,812,969

[45] Date of Patent: Sep. 22, 1998

[54] PROCESS FOR BALANCING THE LOUDNESS OF DIGITALLY SAMPLED AUDIO WAVEFORMS

[75] Inventors: Alfred D. Barber, Jr., Broomfield; James B. Munson, Colorado Springs; Claude Sigel, Boulder, all of Colo.

[73] Assignee: Adaptec, Inc., Milpitas, Calif.

[21] Appl. No.: 417,754

[22] Filed: Apr. 6, 1995

[51] Int. Cl.[6] ..... G10L 3/02

[52] U.S. Cl. ..... 704/224; 704/224; 704/225

[58] Field of Search ..... 381/68, 68.4, 86, 381/102, 104–109; 395/2.33, 2.34; 704/224, 225

[56] References Cited

U.S. PATENT DOCUMENTS

| | | | |
|---|---|---|---|
| 4,301,333 | 11/1981 | Gillette | 395/2.33 |
| 4,352,957 | 10/1982 | Ruether | 395/2.33 |
| 4,611,342 | 9/1986 | Miller et al. | 381/36 |
| 4,853,963 | 8/1989 | Bloy et al. | 381/106 |
| 5,109,415 | 4/1992 | Ishida | 381/109 |
| 5,434,922 | 7/1995 | Miller et al. | 381/108 |
| 5,530,767 | 6/1996 | Yoshida | 381/108 |
| 5,579,404 | 11/1996 | Fielder et al. | 381/106 |

*Primary Examiner*—David R. Hudspeth
*Assistant Examiner*—Michael N. Opsasnick
*Attorney, Agent, or Firm*—Forrest Gunnison

[57] ABSTRACT

A loudness balancing process includes three operations. In a first operation, the user specifies a plurality of digitally sampled audio time domain waveforms and an adjusted maximum loudness for each waveform is generated and stored. This operation includes a retrieve and filter process that identifies a portion of each waveform with a maximum loudness, and an adjust and store process that generates an adjusted maximum loudness that is a maximum loudness for the waveform which is free of audible distortion due to clipping. In a second operation, each stored adjusted maximum loudness is retrieved and filtered. The filtering selects a minimum adjusted maximum loudness that is selected as a global maximum loudness. In a third operation, each waveform in the plurality of waveforms is loudness-balanced based on the global maximum loudness. This three step process assures a consistent maximum loudness across the plurality of waveforms and assures that no audible noise is introduced by loudness balancing process.

16 Claims, 4 Drawing Sheets

Microfiche Appendix Included
(1 Microfiche, 27 Pages)

PROCESS FOR BALANCING THE LOUDNESS OF DIGITALLY SAMPLED AUDIO WAVEFORMS

REFERENCE TO MICROFICHE APPENDIX

Appendix A, which is a part of the present disclosure, is a microfiche appendix consisting of one sheet of microfiche having a total of 27 frames. Microfiche Appendix A is a listing of one embodiment of a computer program used to implement a loudness balancing process, which is described more completely below, and is incorporated herein by reference in its entirety.

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates generally to balancing audio loudness and in particular to the balancing of the loudness of digitally sampled audio waveforms.

BACKGROUND OF THE INVENTION

The development of a multimedia product frequently requires combining several sources of digitally sampled audio data. Similarly, a computer user may use several applications that utilize digitally sampled audio data. In either case, the loudness of digitally sampled audio waveforms is dependent on the volume of the audio source recorded as well as the record volume of the device that did the recording.

The apparent loudness of a recording during playback depends directly on the amplitude of the recorded waveform. When samples from waveforms from different recordings are used by the multimedia developer, the loudness of the resulting sound may vary from waveform to waveform. Similarly, the loudness of the sound may vary from user application to user application. Consequently, the user of the applications or the multimedia product is forced to adjust the volume to compensate for the differences in the playback volumes. At best the constant adjustment of the volume as different audio waveforms are processed is annoying and in fact may be impossible if the waveforms change rapidly.

A technique is needed to assure consistent loudness across a group of waveforms thereby allowing application developers and multimedia developers to provide products with a consistent loudness. However, loudness is a perceptual attribute of the listener, and is virtually impossible to predict exactly from the amplitudes stored in a digitally sampled sound file. The knowledge about loudness is based on results from psychophysical studies using, usually, one or two pure sinusoidal tones.

Sinusoidal tones of the same amplitude have quite different loudnesses, depending on the frequency of the sine wave. FIG. 1 shows, roughly, the relationship between loudness and frequency of the sine wave. Specifically, the horizontal axis is frequency and the vertical axis is a sensitivity factor $S_f$ for the loudness of the corresponding frequency. We hear tones in the range of 20 to 20,000 Hz, and there is a peak in our sensitivity at about 5,000 Hz.

A pure tone can be made louder or softer by changing the amplitude of the tone. FIG. 2 illustrates the relationship between loudness and amplitude for a pure tone. Specifically $$L=kA^{0.6} \tag{1}$$

where

L=loudness;

A=amplitude of the sine wave; and k=a proportionality constant

A combination of two tones of the same frequency sounds louder than either one alone if the time interval between the two is not too great. FIG. 3 shows this relationship, as well as the observation that the size of this temporal summation period is about 200 milliseconds (msec).

The loudness of binaural sounds (one tone to each ear) depends on the sum of amplitudes to each ear. Specifically, the loudness for a tone to each ear is:

$$L=k(A_1+A_r)^{0.6} \tag{2}$$

where subscripts l and r refer to sound received by the left and right ears from the left and right channels of a stereo recording.

Combining two tones of very different frequencies, e.g. a first tone of frequency g and a second tone of frequency h where frequencies g and h are over an octave apart, also results in additive amplitudes when weighted by the relative sensitivities $S_f$ shown in FIG. 1. Specifically, monaural loudness L is:

$$L=k(S_gA_g+S_hA_h)^{0.6} \tag{3A}$$

and stereo loudness L is:

$$L=k(S_g(A_{g1}+A_{gr})+S_h(A_{h1}+A_{hr}))^{0.6} \tag{3B}$$

Typical sounds—music, speech, etc.—are composed of all frequencies at various amplitudes, and the loudness changes continuously with time. Hypothetically, a loudness L(t) for any sound could be calculated by first using a Fourier Transform to convert the time-based data into frequency-based amplitudes; by second, multiplying the amplitude of each frequency by the sensitivity function of FIG. 1; by third, adding the sensitivity factor weighted amplitudes of all the frequencies in each stereo channel together; and by finally, raising the sum of the frequency-based amplitudes to the 0.6 power. The cost in computer time to do this would be prohibitive, however.

Consequently, to the best knowledge of the inventors, a process for balancing the loudness of digitally sampled audio waveforms was not previously available.

SUMMARY OF THE INVENTION

The loudness balancing process of this invention assures a consistent maximum loudness across a group of digitally sampled audio time domain waveforms, sometimes called waveforms. When the loudness balancing process is used on a group of digitally sampled audio time domain waveforms, that each has an arbitrary maximum loudness, the resulting digitally sampled audio time domain waveforms have a consistent maximum loudness. The process of this invention maintains the relative dynamics of a waveform so that louder portions of a waveform remain relatively louder in the equalized waveform. In addition, the loudness balancing process does not introduce any audible noise. The loudness balancing process starts with signals of a first form, i.e., waveforms with an arbitrary maximum loudness from waveform to waveform, and generates signals of a second form, i.e., waveforms with a consistent maximum loudness from waveform to waveform.

In one embodiment, the process for balancing loudness of a plurality of time domain waveforms includes three operations. First, an adjusted maximum loudness is generated for each waveform in the plurality of time domain waveforms based upon samples in that waveform. The adjusted maximum loudness is selected so that no distortion due to clipping occurs. Second, the adjusted maximum loudnesses for each waveform in the plurality of time domain waveforms are filtered to generate a global maximum loudness. Third, each waveform in the plurality of time domain waveforms is loudness equalized using the global maximum loudness to generate a plurality of equalized time domain waveforms. The plurality of equalized time domain waveforms have a balanced maximum loudness and no audible distortion due to clipping is introduced by the process.

In the process of generating an adjusted maximum loudness for each waveform in the plurality of time domain waveforms based upon samples in that waveform, each waveform is filtered chunk by chunk to determine a maximum loudness for the waveform. In addition, each waveform is filtered on a sample by sample basis to determine a sample having a maximum amplitude. Both the maximum amplitude and maximum loudness are stored for use later in the balancing process. Specifically, a clipping coefficient for the waveform is generated using the maximum amplitude. The clipping coefficient is combined with the maximum loudness to generate the adjusted maximum loudness. The adjusted maximum loudness for each waveform in the plurality of waveforms is stored in a memory.

The process of filtering the adjusted maximum loudness for each waveform in the plurality of time domain waveforms to generate a global maximum loudness further includes processing the stored adjusted maximum loudness for each waveform to identify a minimum adjusted maximum loudness. The minimum adjusted maximum loudness is the global maximum loudness.

The process of equalizing each waveform in the plurality of waveforms using the global maximum loudness further includes generating a balancing coefficient for one waveform in the plurality of time domain waveforms. In one embodiment the balancing coefficient for one waveform in the plurality of time domain waveforms is generated by combining the maximum loudness for the one waveform with the global loudness. Finally, each sample in the one waveform is scaled by the balancing coefficient to generate a loudness balanced waveform. This three step process assures a consistent maximum loudness across the plurality of waveforms and assures that no audible noise is introduced by the loudness balancing process.

DETAILED DESCRIPTION

The loudness balancing process of this invention assures a consistent maximum loudness across a group of digitally sampled audio waveforms. When the loudness balancing process is used on a group of digitally sampled audio waveforms, that each has an arbitrary maximum loudness, the resulting digitally sampled audio waveforms have a consistent maximum loudness. Therefore, when a group of digitally sampled audio waveforms, sometimes referred to below as waveforms, have been processed according to the principles of this invention, a user can select a single comfortable speaker volume for all of the processed waveforms.

The process of this invention maintains the relative dynamics of a waveform so that louder portions of a waveform remain relatively louder in the equalized waveform. In addition, the loudness balancing process does not introduce any audible noise. The loudness balancing process starts with signals of a first form, i.e., waveforms with an arbitrary maximum loudness from waveform to waveform, and generates signals of a second form, i.e., waveforms with a consistent maximum loudness from waveform to waveform.

Figure 4:
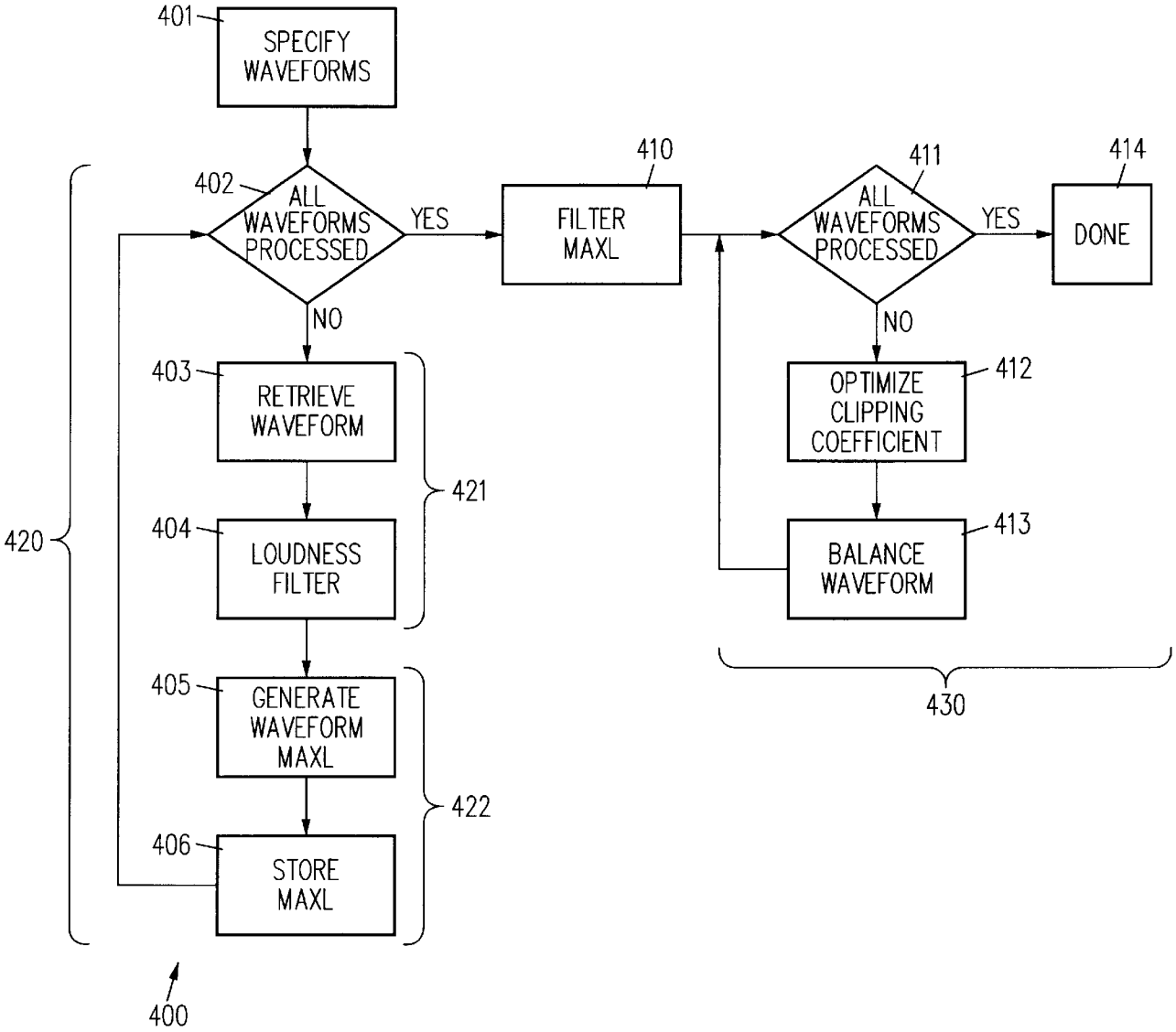
FIG. 4 is a process flow diagram for one embodiment of the loudness balancing process of this invention.

One embodiment of loudness balancing process 400 of this invention is illustrated in FIG. 4. Loudness balancing process 400 is a computer process that runs under Microsoft Windows in this embodiment. However, in view of this disclosure, loudness balancing process 400 could also be implemented all in hardware or alternatively, in a combination of hardware and software.

Loudness balancing process 400 includes three operations. In a first operation, generate adjusted maximum loudness operation 420, the user specifies a plurality of waveforms and an adjusted maximum loudness for each waveform is generated and stored. Operation 420 includes a retrieve and filter process 421 that identifies a portion of each waveform with a maximum loudness, and an adjust and store process 422 that generates an adjusted maximum loudness that is a maximum loudness for the waveform which is free of distortion due to clipping.

In a second operation, filter adjusted maximum loudness step 410, each stored adjusted maximum loudness is retrieved and filtered. The filtering selects a minimum adjusted maximum loudness that is selected as a global maximum loudness.

In a third operation, equalize waveforms 430, each waveform in the plurality of waveforms is loudness-balanced based on the global maximum loudness. As explained more completely below, this three step process assures a consistent maximum loudness across the plurality of waveforms and assures that no audible noise is introduced by loudness balancing process 400.

Specifically, in loudness balancing process 400, the user identifies the various waveforms to be processed in specify waveforms step 401. Upon completion of the specification of the waveforms, processing transfers from step 401 to all waveforms processed check 402.

Initially, since no waveforms have been processed, all waveforms processed check 402 simply transfers directly to retrieve waveform step 403. When all the selected waveforms have been processed, check 402 transfers processing to filter adjusted maximum loudness step 410, that is described more completely below.

In retrieve waveform step 403, the first waveform specified by the user is retrieved for processing. Specifically, the various waveforms specified in step 401 are typically stored on a non-volatile memory and step 403 moves a selected waveform, or at least a portion of the waveform from the non-volatile memory to main memory of the computer system executing loudness balancing process 400. In this embodiment, the waveform is retrieved in increments of a chunk, that is defined more completely below.

After retrieval of the first specified waveform, loudness filter step 404 processes the waveform to determine the maximum loudness within the waveform. In one embodiment, loudness filter step 404 processes the waveform chunk by chunk. Herein, a chunk of a waveform is a portion of the waveform within a predetermined time interval. Each chunk typically includes a plurality of timeslices and each timeslice may have one or more samples. For example, a monaural waveform has one sample per timeslice, while a stereo waveform has two samples per timeslice, one for each channel. Each sample is a waveform amplitude.

Initially in step 404, the loudness for the first chunk is stored as the waveform maximum loudness. The loudness for the second chunk is compared with the stored waveform maximum loudness. If the loudness for the second chunk is greater than the stored waveform maximum loudness, the loudness for the second chunk is stored as the waveform maximum loudness. Next, the loudness for the third chunk is compared with the stored waveform maximum loudness. If the loudness for the third chunk is greater than the stored waveform maximum loudness, the loudness for the third chunk is stored as the waveform maximum loudness. Filter step 404 continues in this fashion until all the chunks in the first waveform have been processed.

When the complete waveform is processed, the stored waveform maximum loudness is considered the waveform maximum loudness for the entire waveform. Upon determination of the waveform maximum loudness for the entire waveform by step 404, processing transfers from loudness filter step 404 to generate waveform MAXL step 405, sometimes referred to as generate adjusted maximum loudness step 405.

To balance the loudness for the set of waveforms requires determination of an adjusted maximum loudness MAXL for each individual waveform. Herein, adjusted maximum loudness MAXL is defined so that the loudest sample in the waveform is not distorted by clipping.

A waveform is made louder by multiplying each sample in the waveform by some quantity greater than one. Similarly, a waveform is made quieter by multiplying each sample in the waveform by a quantity greater than zero but less than one. In generate waveform MAXL step 405, a clipping coefficient is generated so that the product of the clipping coefficient and maximum normalized amplitude sample is one. Consequently, if each sample in the waveform were multiplied by the clipping coefficient, no distortion due to clipping would occur. After the clipping coefficient for the waveform is generated, an adjusted maximum loudness MAXL is generated using a combination of the maximum loudness for the waveform, that was stored in step 404, and the clipping coefficient. Thus, the waveform maximum loudness is adjusted such that adjusted maximum loudness MAXL is the maximum loudness the waveform can have and not introduce distortion caused by clipping.

Following completion of generate waveform MAXL step 405, processing transfers from step 405 to store MAXL step 406, sometime referred to as store adjusted maximum loudness step 406, in which adjusted maximum loudness MAXL is stored for the current waveform. Herein, the current waveform is the waveform being processed. Processing transfers from step 406 to all waveforms processed check 402.

If a waveform remains for processing, step 402 transfers to step 403 and steps 403 to 406 are repeated for the next waveform. When no waveforms remain for processing, step 402 transfers to filter adjusted maximum loudness step 410. Thus, first operation 420 includes steps 401 to 406.

In filter adjusted maximum loudness step 410, hereinafter, filter MAXL step 410, the stored adjusted maximum loudness MAXL is retrieved for each waveform and processed to select the minimum adjusted maximum loudness. The minimum adjusted maximum loudness is set equal to a global maximum loudness OPTMAXL by step 410 and processing transfers from step 410 to all waveforms processed check 411. If all the waveforms have been processed in steps 412 and 413, all waveforms processed check 411 transfers to done step 414 and otherwise to step 412. Third operation 430 includes steps 411 to 414.

In optimize clipping coefficient step 412, the stored waveform maximum loudness for a waveform is retrieved. The retrieved waveform maximum loudness is combined with the global maximum loudness OPTMAXL to generate a balancing coefficient for the waveform.

In balance waveform step 413, the waveform is retrieved. Each sample in the retrieved waveform is combined with the balancing coefficient for that waveform to create an equalized waveform, i.e., a loudness-balanced waveform. Upon completion of balance waveform step 413, processing returns to all waveforms processed check 411.

Each of the waveforms specified in step 401 is processed in turn in steps 412 and 413 and then all waveforms processed check 411 transfers to done step 414. In done step 414, the equalized waveforms are stored in the computer system for subsequent use and loudness balancing process 400 is complete.

The process of this invention assures that the maximum loudness in the set of balanced waveforms does not experience distortion due to clipping. Consequently, none of the loudness-balanced waveforms, i.e., equalized waveforms, are clipped and so the process does not introduce high frequency ripples in the loudness-balanced waveforms that can sound like noise to the human ear. In addition, the entire process is performed in the time-domain. This eliminates the time and expense of transforming the waveforms into a frequency space to perform the loudness-balancing processing.

Prior to considering the steps of loudness balancing process 400 in further detail, the characteristics of loudness and a basis for loudness balancing process 400 are briefly considered. Loudness balancing process 400 includes several simplifications and approximations that have proven to balance loudness across a number of waveforms using only the information in digitally sampled audio files. First, the relative sensitivity to loudness as a function of frequency is taken as a constant for all frequencies, i.e, the sensitivity factor is taken as one. In view of this simplification, the definition of expression (3B) can be represented as:

$$L(t) = k\left(\sum_{f}(A_{fl}(t) + A_{fr}(t))\right)^{0.6} \tag{4}$$

where the summation over f is the summation over all audible frequencies.

Thus, loudness L(t), as defined by expression (4), is a function of all the amplitudes of all audible frequencies of the sound samples in a waveform. Generating loudness L(t) would require a Fourier transform to convert the time domain amplitudes stored in a digitally sampled audio file to the frequency domain amplitudes of expression (4). This may be possible using high speed transforms such as a fast Fourier transform, but this still requires considerable computing resources.

Thus, according to the principles of the invention, loudness is defined as a Minkowski Metric of order p:

$$L^*=((\Sigma V^p)/N)^{1/p} \tag{5}$$

where

V=an amplitude of a time domain digital sample; and

N=number of samples in a predetermined time period.

The particular order p that is selected depends on the particular hardware configuration used to implement loudness balancing process 400.

In particular, for a general purpose computer, an order p of two is advantageous and gives a definition of loudness that is similar to the traditional root mean square (RMS) measure of the power of white noise. Specifically, $$L^*(t0)=\left(\left(\sum_{t=t0}^{t0+T} V^2\right)/N\right)^{0.5} \tag{6}$$

where

L*(t0)=loudness at instant t0;

V=an amplitude of a time domain digital sample; and

N=number of samples in temporal summation time period T for the human ear.

This definition of loudness is a monotonic function, as was the definition of loudness given by expression (4), and makes use of the observation, based on the power of white noise, that two sounds with equal RMS values appear equally loud.

Figure 1:
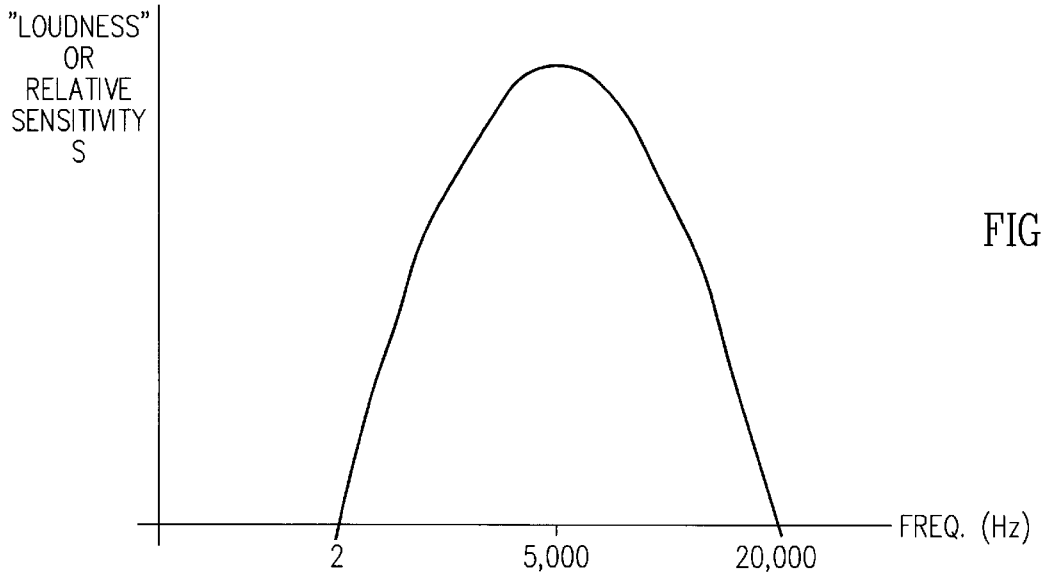
FIG. 1 is a diagram of the sensitivity of the human ear for the loudness of a single sine wave at various frequency sine waves.
Figure 2:
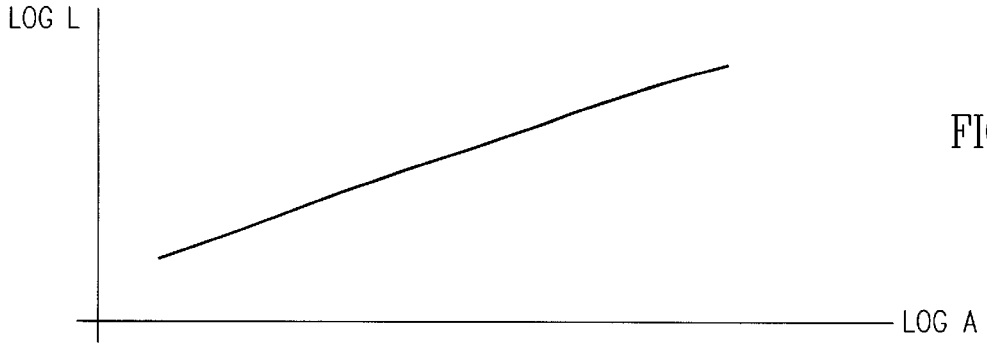
FIG. 2 is a diagram of the monotonic relationship between the loudness of a single tone and the amplitude of that tone.
Figure 3:
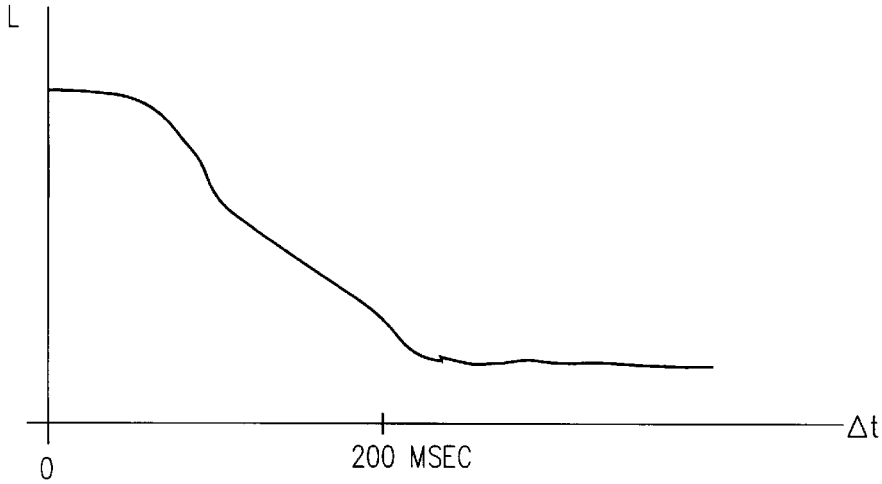
FIG. 3 is a diagram of the temporal summation period for a combination of two tones of the same frequency supported by a time interval $\Delta t$.

The definition of loudness in expression (6) is also based on an examination of the data in FIG. 3 for the temporal summation period of the human ear. The data are usually interpreted as demonstrating that the loudness at any instant t0 is influenced by all the sounds both immediately before and immediately after time t0. The sounds more nearby to time t0 are interpreted as having more influence than the sounds more removed from time t0. The definition of loudness L*(t0) approximates this function over the temporal summation period T as one and zero elsewhere. In one embodiment, based on the data in FIG. 3, temporal summation period T is taken as 200 milliseconds. Thus, loudness is defined as:

$$L^*(t0)=\left(\left(\sum_{t=t0}^{t0+200} V^2\right)/N\right)^{0.5} \tag{7A}$$

where the loudness definition of expression (7A) is for a monaural file and the loudness definition for a stereo file is:

$$L^*(t0)=\left(\left(\sum_{t=t0}^{t0+200} V_1^2+V_r^2\right)/N\right)^{0.5} \tag{7B}$$

As described more completely below, the embodiment of the loudness balancing process of this invention uses the definitions of expressions (7A) and (7B).

Figure 5A:
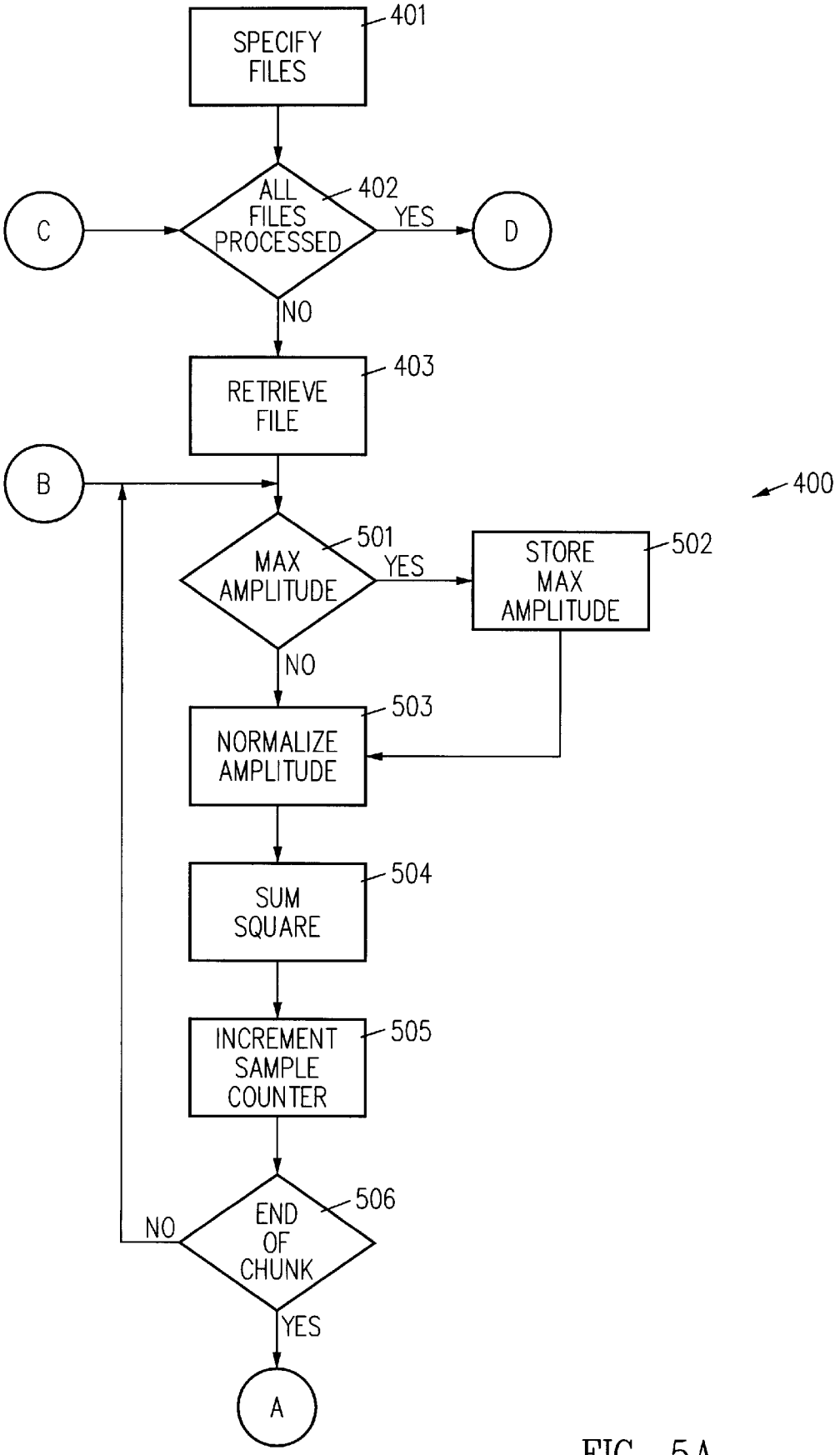
FIGS. 5A to 5C are a more detailed process flow diagram of the loudness balancing process of this invention.
Figure 5B:
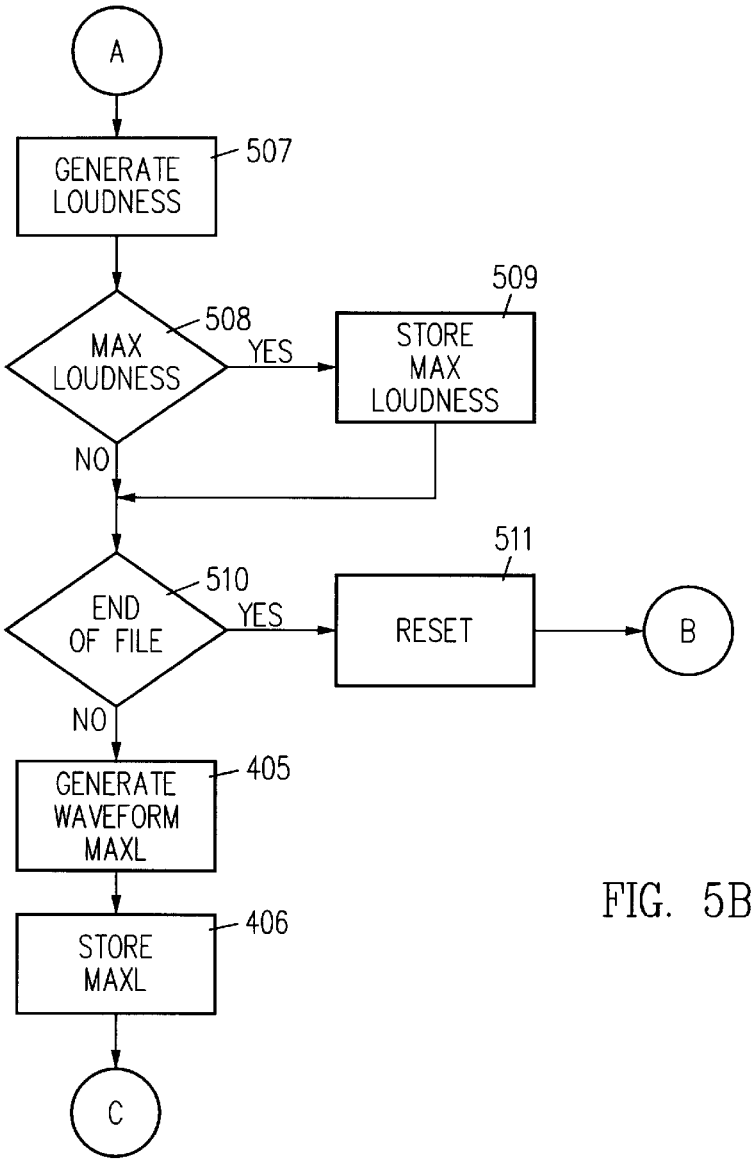
Figure 5C:
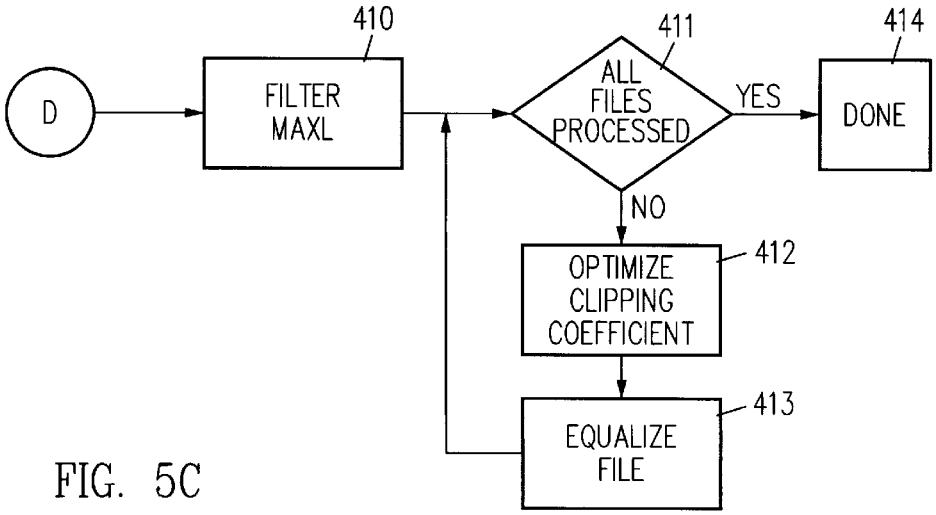

FIGS. 5A to 5C are a more detailed process diagram for loudness balancing process 400 of this invention that includes the approximations and definitions of loudness L*(t0) given in expressions (7A) and (7B). In FIG. 5, each waveform processed is contained in a computer file and so the steps process files rather than waveforms as in FIG. 4. With this change, steps 401, 402, 403, 405, 406, and 410 to 414 are the same as described above and so that description is not repeated with the term file substituted for waveform.

One embodiment of loudness filter step 404 is illustrated in FIG. 5. In maximum amplitude check 501 (FIG. 5A), an absolute value of the amplitude of the current sample is compared with a stored maximum amplitude. In one embodiment for a sixteen bit format, the amplitude can vary from $+(2^{15}-1)$ to $-2^{15}$, and so the absolute value of the amplitude is used. In another embodiment for an eight bit format, the possible amplitude values range from zero to $(2^8-1)$ and zero amplitude is offset to 80h. Thus, for an eight bit format, the offset of 80h is subtracted from the amplitude and then the absolute value is taken. Initially, the stored maximum amplitude is set to zero. Thus, in maximum amplitude check 501, if the absolute value of the amplitude of the current sample is greater than the stored maximum amplitude processing transfers from maximum amplitude check 501 to store maximum amplitude step 502 where the absolute value of the amplitude of the sample is stored as maximum amplitude Vmax. Processing transfers from store maximum amplitude step 502 to normalize amplitude step 503. Conversely, if the absolute value of the amplitude of the current sample is not greater than the stored maximum amplitude processing transfers from check 501 directly to step 503.

In normalize amplitude step 503, the amplitude of the sample is divided by the maximum possible amplitude for a sample to generate a normalized amplitude $\alpha i$. As will be appreciated by those skilled in the art, the maximum possible amplitude is defined by the number of bits used to represent the amplitude. The range for normalized amplitude $\alpha i$ is between plus one and minus one. In loudness filter step 404, normalized samples are used because normalized samples permit use of loudness balancing process 400 to equalize files with different sample sizes, i.e., more bits per sample.

After completion of normalize amplitude step 503, processing transfers to sum square step 504. Sum square step 504 accumulates the sum of the squares of the normalized amplitudes for a chunk. In the initialization process, a sum of squares is set equal to zero, e.g., a storage location for the sum of squares is cleared. Thus, sum square step 504 squares normalized amplitude $\alpha i$; retrieves the stored sum of squares; adds the squared value to the sum of squares; and stores the resulting sum of squares. Upon completion of sum square step 504, processing transfers to increment sample counter 505 which increments a count of the number of samples in the chunk and transfers processing to end of chunk check 506.

End of chunk check 506 determines whether the timeslice currently being processed completes the chunk. In this embodiment, a chunk of the waveform, e.g., file, is a 200 msec time interval. As explained above, this is approximately the temporal summation period for the human ear. However, in view of this disclosure other size chunks can be utilized. Thus, a 200 msec time interval is illustrative only and is not intended to limit the invention to this particular chunk size. If the chunk is complete, processing transfers to generate chunk loudness step 507 (FIG. 5B) and otherwise returns processing to maximum amplitude check 501 (FIG. 5A).

Upon returning to maximum amplitude check 501, steps 501 to 505 are performed for the next sample in a manner identical to that described above. Consequently upon completion of step 505, end of chunk check 506 again transfers processing to one of step 507 and step 501. Herein, elements with the same reference numeral are the same and so in some instances an abbreviated description of the element is used with the reference numeral.

When the amplitudes for a chunk have been normalized and the sum of the squared normalized amplitudes generated, generate chunk loudness step 507 (FIG. 5B) has the sum of squares and the number of samples in the chunk available. In this embodiment, generate chunk loudness step 507 uses the following definition to generate the chunk loudness:

$$L(\text{chunk}) = \left( \sum_i (|\alpha i|)^p \right) / n \tag{8}$$

where

L(chunk)=loudness of a chunk;

Σ=summation of number of samples in chunk;

p=2 in this embodiment;

αi=ith normalized amplitude in chunk; and n=number of timeslices in the chunk.

If the file being processed is a monaural file, number of timeslices n in the chunk is simply the value of the sample counter. Conversely, if the file being processed is a stereo file, number of timeslices n in the chunk is the value of the sample counter divided by two.

Notice that in generate chunk loudness step 507 the square root of the sum of the squares of the normalized amplitudes is not utilized. This is an optimization that increases the performance of loudness balancing process 400. Selecting a waveform maximum loudness from a set of chunk loudnesses that are each defined as the sum of squares of the normalized amplitudes in the chunk gives the same result as selecting a maximum loudness for a chunk from a set of chunk loudnesses that are each defined as the square root of the sum of squares of the normalized amplitudes in the chunk.

Upon generating the loudness for the chunk, step 507 transfers processing to maximum loudness step 508. In maximum loudness step 508, the loudness of the current chunk is compared with a stored waveform maximum loudness λ. If the loudness of the current chunk is greater than stored waveform maximum loudness λ, processing transfers to store waveform maximum loudness step 509 and otherwise to end of file check 510.

Initially, stored waveform maximum loudness λ is zero. Thus, processing transfers from maximum loudness check 508 to store waveform maximum loudness step 509 only when the loudness of a chunk is greater than zero. Processing transfers from store waveform maximum loudness step 508 to end of file check 510.

End of file check 510 determines whether all the data in the current file have been processed. If processing of the file is complete, end of file check 510 transfers processing to step 405 and otherwise to reset step 511.

In reset step 511, the sum of squares is reset to zero and the sample counter is reset to zero. Upon completion of reset step 511, processing transfers to maximum amplitude check 501 (FIG. 5A) and the processing of the next chunk in the file proceeds through steps 501 to 510, as described above. When all the chunks in the file are processed, end of file check 510 transfers to generate adjusted loudness step 405 (FIGS. 4 and 5B).

Upon entering generate adjusted loudness step 405, step 404 has stored maximum amplitude Vmax in the file and waveform maximum loudness λ. In step 405, a clipping coefficient c is first defined so that no clipping of the waveform occurs. Specifically, the condition that must be satisfied to assure no clipping is:

$$|(c)^*(\alpha i)| \leqq 1 \tag{9}$$

for all αi in the waveform.

Thus, in this embodiment, clipping coefficient c is defined as $$|(c)^*(\alpha max)| = 1 \tag{10}$$

where αmax is the normalized value of stored maximum amplitude Vmax. Thus, the first step in step 405 is to generate clipping coefficient c using expression (10). Clipping coefficient c is the maximum multiplier that can be applied to the waveform in loudness balancing process 400. Therefore, loudness balancing process 400 does not cause clipping of any waveform that is processed.

After clipping coefficient c is generated in generate adjusted loudness step 405, the adjusted maximum loudness MAXL is generated. Specifically, adjusted maximum loudness MAXL is:

$$MAXL = \lambda^* c^2 \tag{11}$$

where each of the terms was previously defined. Notice that the square of clipping coefficient c is used because waveform maximum loudness λ was generated using a sum of squares of the normalized amplitudes in the chunk. Upon completion of step 405, store adjusted loudness step 406 saves adjusted maximum loudness MAXL in memory and transfers processing to all files processed step 402. As described above, when all the files specified in step 401 have been processed in steps 403 to 406, step 402 transfers to filter MAXL step 410.

In filter MAXL step 410, the minimum adjusted maximum loudness, that was stored in step 406, is set equal the global maximum loudness OPTMAXL and processing transfers from step 410 to all waveforms processed check 411. If all the waveforms have been processed in steps 412 and 413, all waveforms processed check 411 transfers to done step 414 and otherwise to step 412.

In optimize clipping coefficient step 412, the stored waveform maximum loudness λ is retrieved. Retrieved waveform maximum loudness λ is combined with the global maximum loudness OPTMAXL to generate a balancing coefficient OPTC for the waveform. In this embodiment, $$OPTC = (OPTMAXL/\lambda)^{0.5} \tag{12}$$

where OPTC is the balancing coefficient.

In balance waveform step 413, the waveform is retrieved. Each sample in the retrieved waveform is scaled, e.g., multiplied, by balancing coefficient OPTC for that waveform to create an equalized waveform that is stored. Upon completion of equalize waveform step 412, processing returns to all waveforms processed check 411.

In one embodiment of this invention, loudness balancing process 400, as presented in Microfiche Appendix A and incorporated herein by reference in its entirety, was written in the C computer language. The program was compiled and linked using Borland C++ for Windows, Version 4.02, that is available from Borland of Scotts Valley, Calif. The resulting object code executes on a personal computer with an Intel 386 or greater microprocessor or equivalent under the Microsoft Windows, Version 3.1 with a DOS operating system compatible therewith. This citation of a particular computer programming language, personal computer microprocessor, graphic user's interface, and operating system is illustrative only and is not intended to limit the invention to the specific systems cited. In view of this disclosure, the loudness balancing process of this invention can be implemented in a wide variety of programming languages using a wide variety of processors. For example, a RISC or a Motorola processor could be utilized.

Loudness balancing process 400 accepts files stored in any uncompressed digitally sampled audio format. Of course, compressed digitally sampled audio files can also be used after decompression. Loudness balancing process 400 can be implemented either as a stand alone process, or as part of a library of computer processes.

The embodiment described above of the loudness balancing process of this invention is illustrative of the principles of this invention and is not intended to limit the invention to the particular embodiment described. In view of this disclosure, those skilled in the art can implement the time domain loudness balancing process in a wide variety of ways and in a wide variety of applications.

We claim:

1. A method for balancing loudness of a plurality of time domain waveforms comprising:

generating an adjusted maximum loudness, for each time domain waveform in said plurality of time domain waveforms, based upon samples in that time domain waveform wherein said adjusted maximum loudness is selected so that no audible distortion due to clipping occurs;

filtering said adjusted maximum loudness for each time domain waveform in said plurality of time domain waveforms to generate a global maximum loudness; and equalizing each time domain waveform in said plurality of time domain waveforms using said global maximum loudness to generate a plurality of equalized time domain waveforms wherein said plurality of equalized time domain waveforms have a balanced maximum loudness and no audible distortion due to clipping is introduced by said method.

2. A method for balancing loudness of a plurality of time domain waveforms as in claim 1 wherein said generating an adjusted maximum loudness, for each time domain waveform in said plurality of time domain waveforms, based upon samples in that time domain waveform further comprises:

filtering said time domain waveform chunk by chunk to determine a maximum loudness for said time domain waveform.

3. A method for balancing loudness of a plurality of time domain waveforms as in claim 2 wherein said generating an adjusted maximum loudness, for each time domain waveform in said plurality of time domain waveforms, based upon samples in that time domain waveform further comprises:

filtering said time domain waveform on a sample by sample basis to determine a sample having a maximum amplitude.

4. A method for balancing loudness of a plurality of time domain waveforms as in claim 3 wherein said generating an adjusted maximum loudness, for each time domain waveform in said plurality of time domain waveforms, based upon samples in that time domain waveform further comprises:

generating said adjusted maximum loudness based on said maximum loudness.

5. A method for balancing loudness of a plurality of time domain waveforms as in claim 4 wherein generating said adjusted maximum loudness based on said maximum loudness further comprises:

generating a clipping coefficient for said time domain waveform using said sample having said maximum amplitude.

6. A method for balancing loudness of a plurality of time domain waveforms as in claim 5 wherein generating said adjusted maximum loudness based on said maximum loudness further comprises:

combining said clipping coefficient and said maximum loudness to generate said adjusted maximum loudness.

7. A method for balancing loudness of a plurality of time domain waveforms as in claim 6 wherein said generating an adjusted maximum loudness, for each time domain waveform in said plurality of time domain waveforms, based upon samples in that time domain waveform further comprises:

storing in a memory said adjusted maximum loudness for each time domain waveform in said plurality of time domain waveforms.

8. A method for balancing loudness of a plurality of time domain waveforms as in claim 1 wherein said generating an adjusted maximum loudness, for each time domain waveform in said plurality of time domain waveforms, based upon samples in that time domain waveform further comprises:

storing in a memory said adjusted maximum loudness for each time domain waveform in said plurality of time domain waveforms.

9. A method for balancing loudness of a plurality of time domain waveforms as in claim 8 wherein said filtering said adjusted maximum loudness for each time domain waveform in said plurality of time domain waveforms to generate a global maximum loudness further comprises:

processing said stored adjusted maximum loudness for each time domain waveform to identify a minimum adjusted maximum loudness.

10. A method for balancing loudness of a plurality of time domain waveforms as in claim 9 wherein said filtering said adjusted maximum loudness for each time domain waveform in said plurality of time domain waveforms to generate an adjusted maximum loudness further comprises:

setting said minimum adjusted maximum loudness equal to said global maximum loudness.

11. A method for balancing loudness of a plurality of time domain waveforms as in claim 1 wherein said filtering said adjusted maximum loudness for each time domain waveform in said plurality of time domain waveforms to generate a global maximum loudness further comprises:

processing said adjusted maximum loudness for each time domain waveform to identify a minimum adjusted maximum loudness.

12. A method for balancing loudness of a plurality of time domain waveforms as in claim 11 wherein said filtering said adjusted maximum loudness for each time domain waveform in said plurality of time domain waveforms to generate a global maximum loudness further comprises:

setting said minimum adjusted maximum loudness equal to said global maximum loudness.

13. A method for balancing loudness of a plurality of time domain waveforms as in claim 1 wherein equalizing each time domain waveform in said plurality of time domain waveforms using said global maximum loudness further comprises:

generating a balancing coefficient for one time domain waveform in said plurality of time domain waveforms.

14. A method for balancing loudness of a plurality of time domain waveforms as in claim 13 wherein said generating a balancing coefficient for one time domain waveform in said plurality of time domain waveforms further comprises:

combining a time domain waveform maximum loudness for said one waveform with said global maximum loudness.

15. A method for balancing loudness of a plurality of time domain waveforms as in claim 13 wherein equalizing each time domain waveform in said plurality of time domain waveforms using said global maximum loudness further comprises:

scaling samples in said one time domain waveform by said balancing coefficient to generate a loudness balanced time domain waveform.

16. A method for balancing loudness of a plurality of time domain waveforms comprising:

filtering a time domain waveform chunk by chunk to determine a maximum loudness for said time domain waveform;

generating an adjusted maximum loudness for said time domain waveform using said maximum loudness wherein said adjusted maximum loudness is selected so that no audible distortion due to clipping occurs;

repeating the filtering and generating operations for each time domain waveform in said plurality of time domain waveforms;

filtering said adjusted maximum loudness for each time domain waveform in said plurality of time domain waveforms to generate a global maximum loudness; and equalizing each time domain waveform in said plurality of time domain waveforms using said global maximum loudness to generate a plurality of equalized time domain waveforms wherein said plurality of equalized time domain waveforms have a balanced maximum loudness and no audible distortion due to clipping is introduced by said method.

* * * * *